US007478582B2

(12) United States Patent
Kubota et al.

(10) Patent No.: US 7,478,582 B2
(45) Date of Patent: Jan. 20, 2009

(54) HIGH PRESSURE PUMP AND MANUFACTURING PROCESS THEREOF

(75) Inventors: Eiichi Kubota, Chiyoda-ku (JP); Aikawa Shigeo, Chiyoda-ku (JP); Michio Yoshida, Chiyoda-ku (JP); Yasuhiro Kajiyama, Chiyoda-ku (JP); Hiroyuki Yamada, Chiyoda-ku (JP)

(73) Assignee: Hitachi, Ltd., Tokyo (JP)

( * ) Notice: Subject to any disclaimer, the term of this patent is extended or adjusted under 35 U.S.C. 154(b) by 756 days.

(21) Appl. No.: 10/781,631

(22) Filed: Feb. 20, 2004

(65) Prior Publication Data

US 2004/0179963 A1 Sep. 16, 2004

(30) Foreign Application Priority Data

Mar. 14, 2003 (JP) ..... 2003-069072

(51) Int. Cl.
*F01B 31/00* (2006.01)

(52) U.S. Cl. ..... 92/86; 92/162 R; 92/169.1

(58) Field of Classification Search ..... 92/86, 92/162 R

See application file for complete search history.

(56) References Cited

U.S. PATENT DOCUMENTS 4,776,260 A * 10/1988 Vincze ..... 92/86
5,125,807 A 6/1992 Kohler et al.

FOREIGN PATENT DOCUMENTS

| | | |
|---|---|---|
| EP | 0537911 A1 | 4/1993 |
| EP | 1277951 A2 | 1/2003 |
| JP | 2001-295727 | 10/2001 |
| JP | 2002-130079 | 5/2002 |

OTHER PUBLICATIONS

English Abstract of JP 2002-130079.
English Abstract of JP 2001-295727.

* cited by examiner

*Primary Examiner*—F. Daniel Lopez
(74) *Attorney, Agent, or Firm*—Crowell & Moring LLP

(57) ABSTRACT

The problems can be solved by ensuring that Ga≦Gb<Gc or Ga<Gb≦Gc, wherein Ga denotes a clearing between the bore on the portion from the compression chamber of the high pressure pump to the cylindrical groove and the plunger, where a transverse aperture is connected with the bore through a cylindrical groove provided halfway through the bore of a cylinder; Gb a clearance closer to the cylindrical groove, out of the clearances between the bore from the cylindrical groove to the drive source side and the plunger; and Gc a clearance closer to the drive source side, out of the clearances between the bore from the cylindrical groove to the drive source side and the plunger.

9 Claims, 7 Drawing Sheets

HIGH PRESSURE PUMP AND MANUFACTURING PROCESS THEREOF

FIELD OF THE INVENTION

The present invention relates to a plunger type high pressure pump, particularly to a single cylinder type high pressure fuel pump particularly suited for use in a gasoline direct injection engine.

RELATED ART

In a high pressure pump of a gasoline direct injection engine, the leakage of gasoline from the clearance must be minimized by reducing the clearance of the plunger sliding in the cylinder bore in, for example, several microns or less, in order to compress low viscosity gasoline to a high pressure. To ensure that the gasoline leaking from the clearance escapes to the low pressure side, a cylindrical groove and transverse aperture connected to the low pressure side are spaced from the ends of the bore.

In this type of pump according to the prior art, both the bore and plunger have required a high diametric dimensional accuracy and cylindricity over the entire sliding surface in order to ensure a small clearance. To meet such requirements, much cost has been needed for precision finishing and subsequent checking. In mass production, high accuracy requirements could not be met, and sliding failure has occurred. To improve slidability, clearance has to be increased at the sacrifice of pump efficiency in some cases.

A high pressure pump of this type according to the prior art method is disclosed in the Japanese Application Patents Laid-Open Publication Nos. 2002-130079 and 2001-295727.

Patent Document 1; Japanese Application Patent Laid-Open Publication No. 2002-130079

Patent Document 2; Japanese Application Patent Laid-Open Publication No. 2001-295727.

SUMMARY OF THE INVENTION

The aforementioned prior art fails to give consideration to productivity, and has such a problems that costs are increased if high accuracy is to be achieved, and productivity has been neglected. To solve this problem, the clearance has to be increased at the sacrifice of pump performances in order to increase productivity.

An object of the present invention is to provide a high pressure pump and manufacturing method thereof, wherein the amount of gasoline leaked between the cylinder and plunger is minimized and smooth sliding is ensured, without reducing the productivity of the pump despite improved accuracy.

DESCRIPTION OF THE INVENTION

Figure 1:
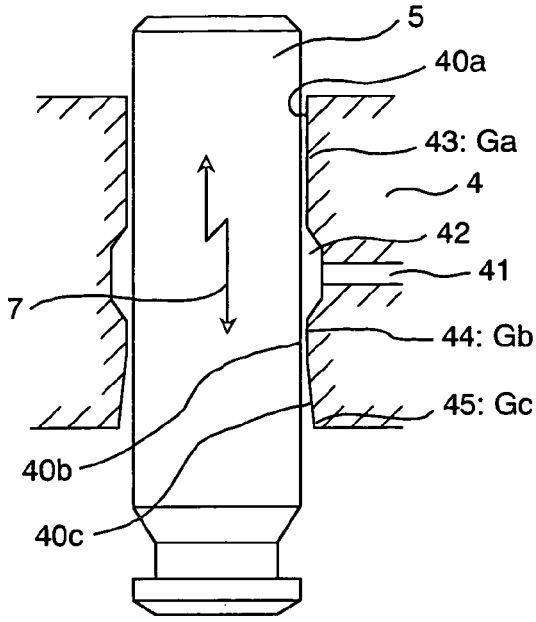
FIG. 1 is a cross sectional view representing the cylinder and plunger of a high pressure pump as an embodiment of the present invention.
Figure 2:
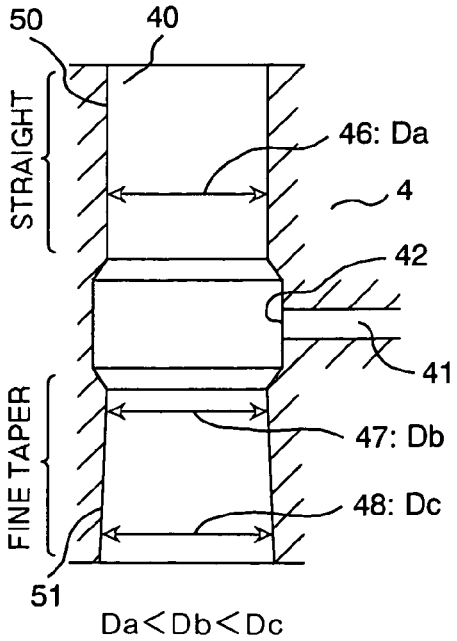
FIG. 2 is a cross sectional view representing the cylinder of a high pressure pump as an embodiment of the present invention.

To solve the aforementioned problems, the present invention is characterized in that the clearance between the bore and plunger differs according to the specified position of either the plunger or bore.

Further, the present invention is characterized in that $Ga \leqq Gb < Gc$ or $Ga < Gb \leqq Gc$, wherein Ga denotes a clearing between the bore on the portion from the compression chamber to the cylindrical groove and the plunger; Gb a clearance closer to the cylindrical groove, out of the clearances between the bore from the cylindrical groove to the drive source side and the plunger; and Gc a clearance closer to the drive source side, out of the clearances between the bore from the cylindrical groove to the drive source side and the plunger.

The present invention is further characterized in that the longitudinal section of the cylindrical groove exhibits a form gradually widening toward the bore of the cylinder, and the angle formed at the portion where the cylindrical groove contacts the bore is 5 degrees or more, but not more than 25 degrees with respect to axial direction of the bore.

DESCRIPTION OF THE PREFERRED EMBODIMENT

The following are reference numerals used in the Drawings:

1 denotes high pressure pump, 2 housing, 3 drive source, 4 cylinder, 5 plunger 6 compression chamber, 7 reciprocating motion, 40 bore, 41 transverse aperture, 42 cylindrical groove, 43 clearance ga, 44 clearance gb, 45 clearance gc, 46 inner diameter da, 47 inner diameter db, 48 inner diameter dc, 50, 52, 54, 54 straight section, 51 fine tapered portion, 53, 55 (minute) flare hole, 60 axial length la, 61 axial length w, 62 axial length lbc, 63 contact point (upper portion), 64 contact point (lower portion), 70 honing stone, 71. honing stone spindle, 72 feed rate va, 73 feed rate vb, 74 fed rate vc, 80 flared portion (upper side), 81 flared portion (lower side), 82 angle (upper side), 83 angle (lower side), 84 minute slack (upper side), 85 minute slack (lower side), 90 sliding inhibiting factor, 91 sealing member, 501 one end of plunger (compression chamber side), and 502 one end of plunger (drive source side).

One of the embodiments of the present invention is characterized in that Ga≦Gb<Gc or Ga<Gb≦Gc, wherein Ga denotes a clearing between the bore and plunger on the portion leading to the cylindrical groove from the compression chamber of a high pressure pump where a transverse aperture is connected with the bore through a cylindrical groove provided halfway through the bore of the cylinder; Gb a clearance closer to the cylindrical groove, out of the clearances between the bore from the cylindrical groove to the drive source side and the plunger; and Gc a clearance closer to the drive source side, out of the clearances between the bore from the cylindrical groove to the drive source side and the plunger.

To achieve this clearance relationship using the machined profile on the cylinder bore side, arrangements are made to get Da≦Db<Dc or Da<Db≦Dc wherein:

Da denotes an inner diameter of the bore on the portion from the compression chamber of the top portion of the cylinder to the cylindrical groove;

Db an inner diameter closer to the cylindrical groove, out of the inner diameters of the bore from the cylindrical groove to the drive source side; and Dc an inner diameter closer to the drive source side, out of the inner diameters of the bores of the cylinder from the cylindrical groove to the drive source side.

To minimize the leakage of gasoline and to secure the sliding length (axial length) thereby providing strength to the lateral load, arrangements are made to ensure that Gc≦((La+W+Lbc)/La)×Ga or Dc≦((La +W+Lbc)/La)×Da; wherein La is the width of the cylinder bore in the axial direction on the portion from the compression chamber to the cylindrical groove; W the width of the cylindrical groove in the axial direction; and Lbc the width of the portion from the cylindrical groove to the drive source side.

A method for manufacturing such a pump is characterized in that, with respect to the conditions for honing the bore on the portion from the compression chamber of a pump cylinder to a cylindrical groove, the conditions for honing the bore on the portion from the cylindrical groove to the drive source side are determined by changing one or more of the axial feed rate, honing stone speed, number of reciprocating motions and axial feed dwell time of the honing tool.

In a high pressure pump where a transverse aperture is connected with the bore through a cylindrical groove provided halfway through the bore of the cylinder, the longitudinal section of the cylindrical groove exhibits a form gradually widening toward the bore of the cylinder, and the angle formed at the portion where the cylindrical groove contacts the bore is 5 degrees or more, but not more than 25 degrees with respect to axial direction of the bore.

Further, in order to reduce the displacement of the center shafts of the bores on the top (compression chamber side) and bottom (drive source side) of the cylindrical groove, the width W of the cylindrical groove in the axial direction is D×0.1 or more, but not more than D×0.6 with respect to the inner diameter D of the bore.

A method for manufacturing such a pump is characterized in that, with respect to the conditions for honing the bore on the portion from the compression chamber of a cylinder to a cylindrical groove and the conditions for honing the bore on the portion from the cylindrical groove to the drive source side, the conditions for honing the bore on the portion connected to the cylindrical groove determined by changing one or more of the axial feed rate, honing stone speed, number of reciprocating motions and axial feed dwell time of the honing tool.

Figure 12:
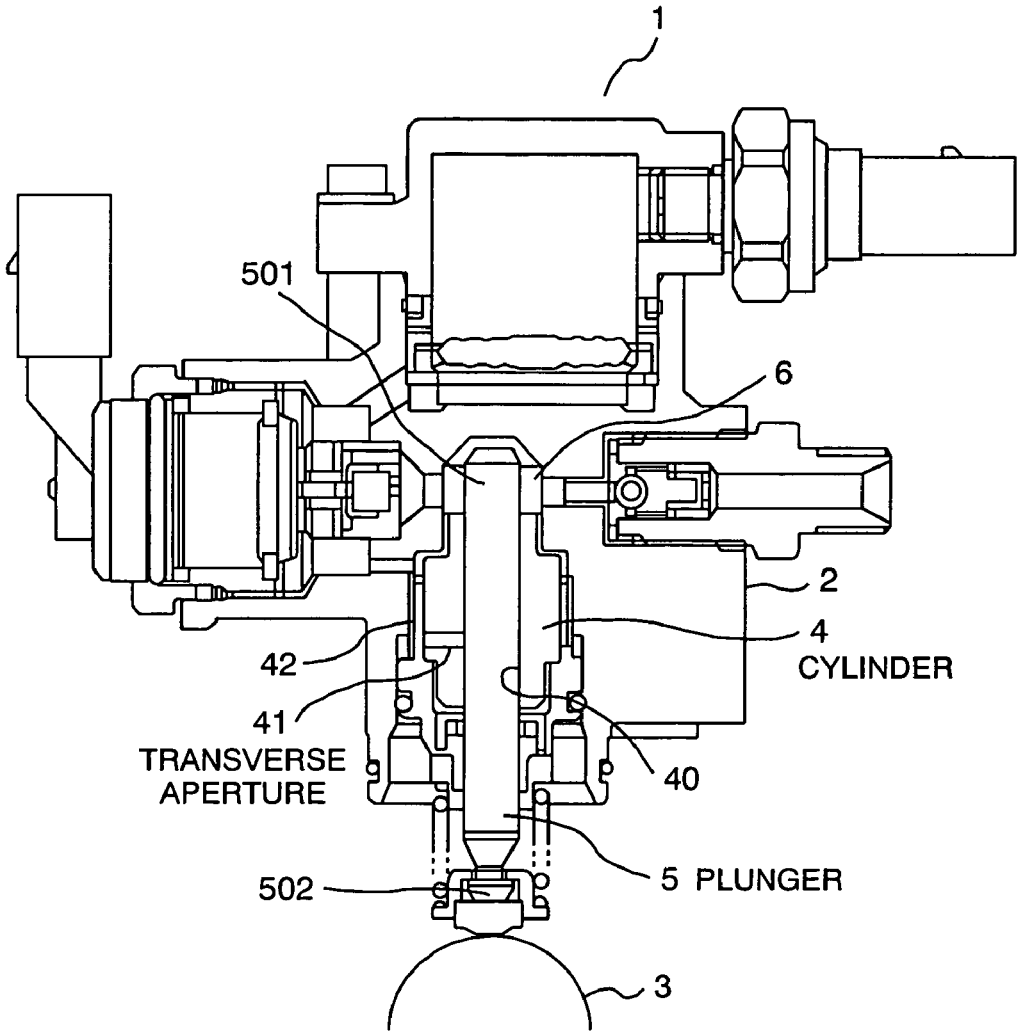
FIG. 12 is a cross sectional view representing a high pressure pump as an embodiment of the present invention.

The following describes the embodiments of the present invention:

Referring to FIG. 12, the following describes the configuration of a high pressure pump. A single cylinder high pressure fuel pump 1 for gasoline direct injection engine shown in FIG. 12 contains a cylinder 4 and a plunger 5 performing a reciprocating motion between the cylinder 4 and bore 40, in the housing 2. One end 501 of the plunger 5 is connected to a compression chamber 6, and the other end 502 of the plunger is connected to the drive source 3 as a drive cam for reciprocating motion through a tappet member. A cylindrical groove 42 and a transverse aperture 41 connected thereto are formed close to the center of the cylinder 4. When the plunger 5 moves in the upward direction in the figure, the gasoline inside the compression chamber 6 is compressed. If the plunger 5 moves in the downward direction in the figure, the gasoline is sucked into the compression chamber 6. Loss in the pump efficiency caused by reciprocating motion of the plunger 5 includes the leakage of gasoline from the space between the bore 40 of the cylinder 4 and plunger 5, namely the clearance. If a excessive amount of gasoline leaks, the delivery rate of the pump 1 will be reduced, and combustion pressure fails to rise to a specified level, in extreme cases. Especially when gasoline is used as a fluid to be compressed, this problem is conspicuous since its has an extremely low viscosity. To solve the problem, the clearance between the cylinder 4 and plunger 5 must be kept to a very small level of several microns.

Since gasoline is poor in lubricity, the cylinder 4 and/or plunger 5 may be worn due to the reciprocating motion 7 of the plunger 5. To avoid such a problem and to make an effective use of energy from the drive source, smooth sliding of the plunger 5 must be ensured. This presents a problem when reducing the clearance dimensions. Further, this pump contains a transverse aperture 41 and a cylindrical groove 42 connected to the low pressure chamber in order to return the fuel leaking from the clearance 43 to the low pressure side, in such a way that the pressure of the fuel leaking from the compression chamber 6 is not applied to a sealing member 91 directly.

FIG. 1 is an partially enlarged view of the cylinder 4 and plunger 5. In the present embodiment, the clearance between the cylinder 4 and plunger 5 was not formed over the entire area on the upper and lower portions with the cylindrical groove sandwiched in-between, but was kept to a very small clearance 40*a* (e.g. 3 μm) from the compression chamber to the cylindrical groove. Clearances 40*b* and 40*c* slightly larger than the 40*a* were formed on the side below the cylindrical groove. Honing is commonly used for precision finishing of a hole such as this bore. Honing operation is characterized in that, if there is a cylindrical groove 42 or the like halfway through the hole, distribution of the honing force applied to the honing stone undergoes fluctuation, and honing accuracy is deteriorated without the bore misalignment on the upper and lower parts of the cylindrical groove 42 being not corrected. In the present embodiment, the section from the compression chamber 6 and cylindrical groove 42 where high pressure fuel leakage must be minimized can be specified so that the specified section is precision-finished. This allows the clearance Ga 43 to be reduced, and ensures the smooth sliding operation at the same time.

The following describes another embodiment with reference to FIG. 2 through FIG. 5: To get the same effect as that in the aforementioned embodiment, a precision straight hole having an inner diameter Da 46 is formed on the straight portion 50 above the cylindrical groove 42 of the bore 40 of the cylinder 4, and the fine tapered portion 51 below the cylindrical groove 42 is provided with a very small taper in the embodiment given in FIG. 2, in such a way as to get the relationship of Da<Db<Dc.

Figure 3:
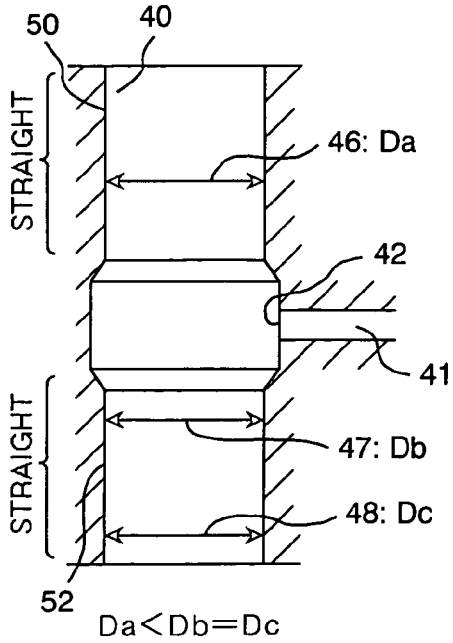
FIG. 3 is a cross sectional view representing the cylinder of a high pressure pump as an embodiment of the present invention.

In the embodiment of FIG. 3, a straight hole having an inner diameter slightly larger than the Da above the cylindrical groove 42 is formed below the cylindrical groove 42. To be more specific, arrangements are made such that Da<Db=Dc.

Figure 4:
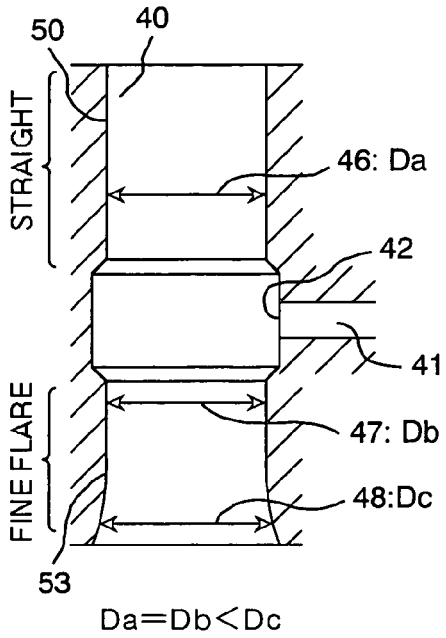
FIG. 4 is a cross sectional view representing the cylinder of a high pressure pump as an embodiment of the present invention.

In the embodiment of FIG. 4, a fine flared hole is formed below the cylindrical groove 42 and arrangements are made such that Da=Db<Dc.

Figure 5:
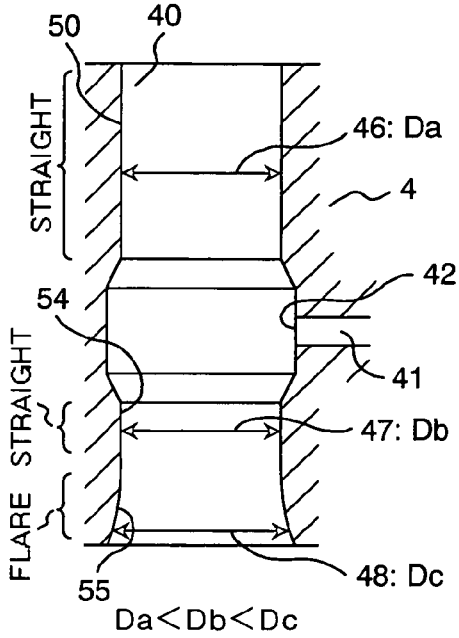
FIG. 5 is a cross sectional view representing the cylinder of a high pressure pump as an embodiment of the present invention.

In the embodiment of FIG. 5, a straight hole 54 and a flared hole 55 connected thereto are formed below the cylindrical groove 42 arrangements are made such that Da<Db<Dc.

The same effect as that in EMBODIMENT 1 is obtained.

Figure 6:
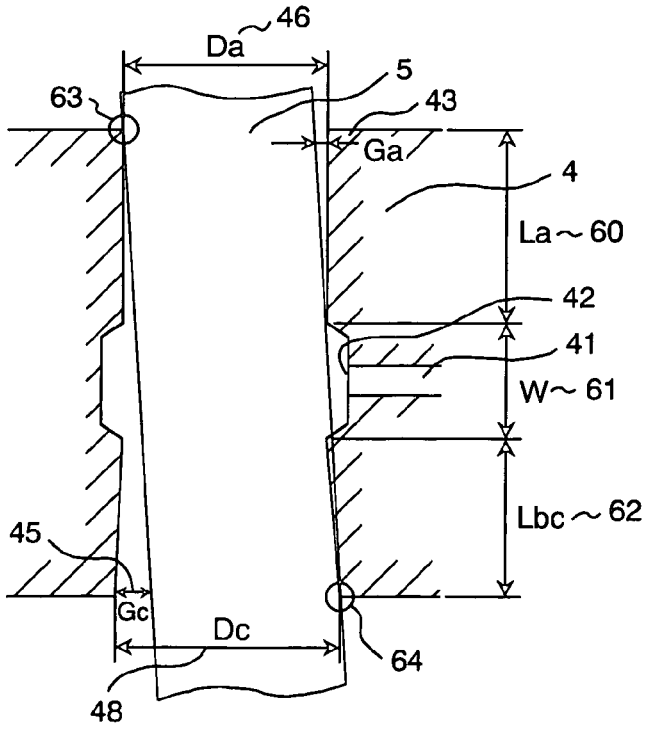
FIG. 6 is a cross sectional view representing the cylinder and plunger of a high pressure pump as an embodiment of the present invention.

A further embodiment will be described with reference to FIG. 6: Arrangements are made in such a way that Gc≦((La+W+Lbc)/La)×Ga or Dc≦(La+W +Lbc)/La)×Da, based on the axial length La 60 as an axial width of the portion from the compression chamber 6 to the cylindrical groove 42, of the bore 40 of the cylinder 4, the axial length W61 as an axial width of the cylindrical groove 42, and axial length Lbc 62 as an width on the portion from the cylindrical groove 42 to the drive source side. As shown in the aforementioned embodiment, when the minimum clearance is restricted only to the portion above the cylindrical groove, the strength with respect to the lateral load may be reduced, as compared to the case where the plunger is guided over the entire area above and below. In this embodiment, even when consideration is given to the maximum inclination of the plunger during sliding operation, the plunger can be guided by the upper portion 63 and lower portion 64 of the bore of the cylinder 4. This provides a sufficient strength with respect to the lateral load applied to the plunger 5.

Figure 7:
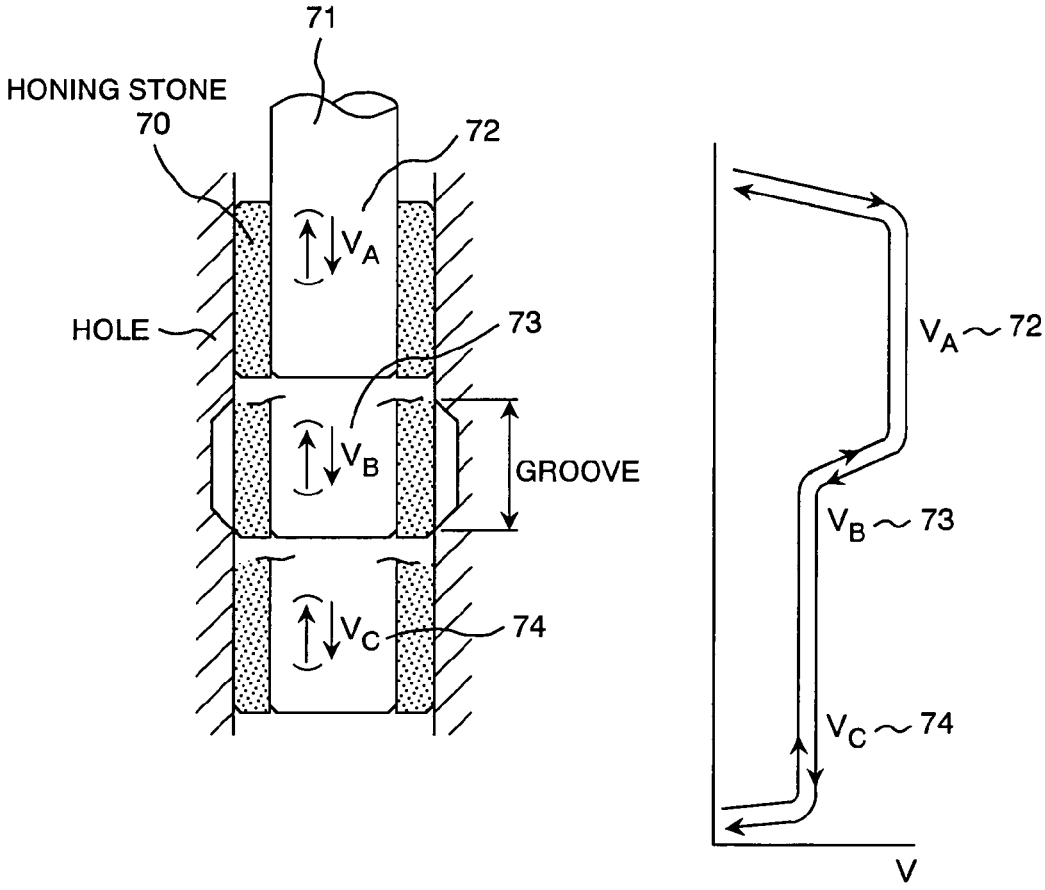
FIG. 7 is a cross sectional view representing the honing process of the cylinder of a high pressure pump as an embodiment of the present invention.

The following describes a further embodiment of the method for forming a bore of the cylinder mentioned in the aforementioned embodiment, with reference to FIG. 7: Numeral 70 denotes a honing stone for finishing the bore 40 of the cylinder 4. Numeral 71 indicates the honing stone spindle. In this embodiment, the lower part feed rate Vc74 is gradually reduced with respect to the axial honing stone feed rate Va72 and axial honing stone feed rate Vb73 of the cylindrical groove 42 in the honing process. In the honing operation, honing is performed with a very slight elastic deformation occurring to the honing stone, honing stone spindle and its connections. A slight increase in the machining diameter is caused by this elastic deformation when the axial feed rate is reduced. In this embodiment, this principle is used to control the speed, thereby forming the optimum bore profile as shown in the aforementioned embodiments.

The same effect can be obtained by changing one or more of the speed of the honing stone 70, number of reciprocating motions and axial feed dwell time.

Figure 8:
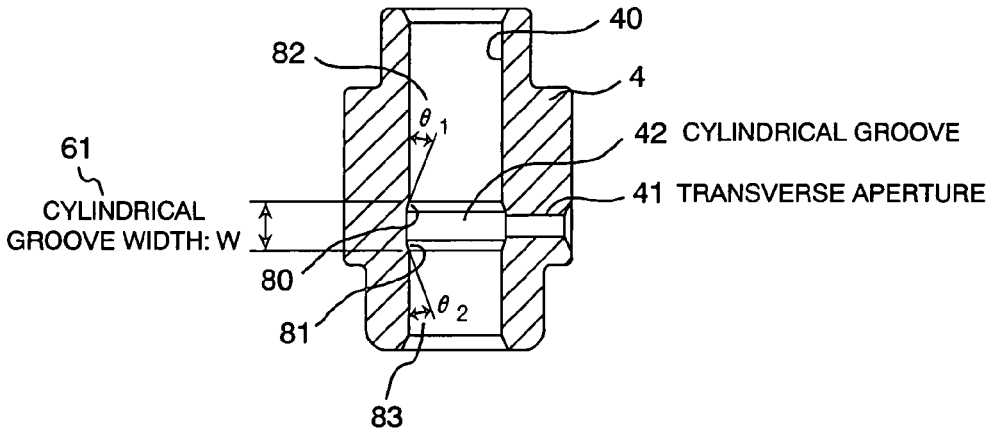
FIG. 8 is a cross sectional view representing the cylinder of a high pressure pump as an embodiment of the present invention.

The following describes a still further embodiment with reference to FIG. 8: In this embodiment, the longitudinal section of the cylindrical groove 42 exhibits a form gradually widening toward the bore 40 of the cylinder 4 and the angles 82 and 83 formed at the portion where the cylindrical groove 42 contacts the bore 4 (two flared portions (upper side) and (lower side) 80 and 81) each are 5 degrees or more, but not more than 25 degrees with respect to axial direction of the bore. It has been verified that a minute slack (upper side) 84 and a minute slack (lower side) 85 as the intersections between the portions 80 and 81 of the cylindrical groove 42 and bores 40 are formed in a very smooth shape, when the bore 40 is finished by honing. This is because generation of burrs is reduced in the range from 5 to 25 degrees during the honing operation wherein these burrs are caused by very slightly plastic deformation of the top surface layer of the cylinder 4, and at the same time, a smooth radius is formed by the aforementioned slight plastic deformation on the side of the honing stone; namely, this is caused by a synergistic effect of these two factors. Thus, smooth sliding is obtained even when the clearance Ga 43 between the cylinder 4 and plunger 5 is reduced by the minute slack (upper side) 84 and minute slack (lower side) 85 forming this smooth radius.

Figure 9:
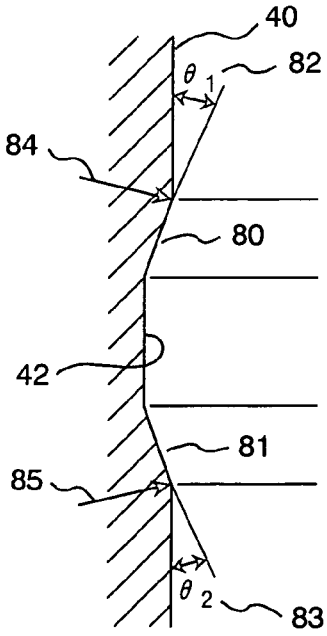
FIG. 9 is a cross sectional view representing the enlarged view of the cylindrical groove of the cylinder given in FIG. 8.
Figure 10:
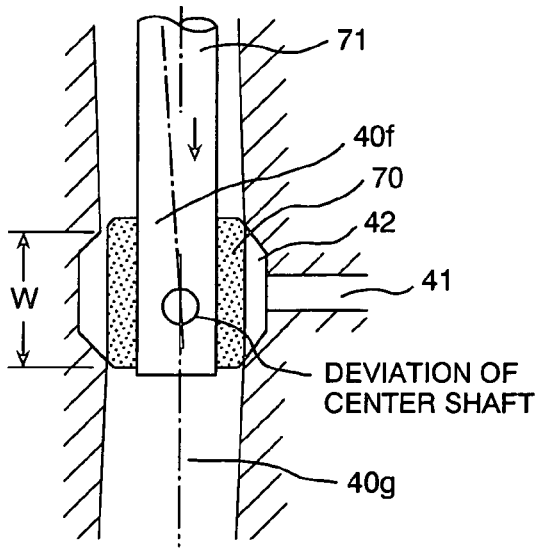
FIG. 10 is a cross sectional view representing the status of honing a cylinder according to the prior art.

In addition to the aforementioned embodiments, the axial length 61 as an axial width W of the cylindrical groove 42 was configured to ensure that D×0.1 or more, but not more than D×0.6, with respect to the bore inner diameter D, as shown in FIG. 9. If the axial length W61 as a width is larger, the honing stone 70 becomes unstable temporarily at a position close to the cylindrical groove 42, as shown in FIG. 10. This makes it difficult to correct the axial misalignment. Theoretically, stability can be ensured by use of a axially long honing stone, but in actual practice, it is difficult to achieve a precisely close contact with the bore 40 over the entire length of a long stone. This requires the groove width W to be made shorter. According to experiments, "W" should be kept in the range from D×0.1 through D×0.6.

Figure 11:
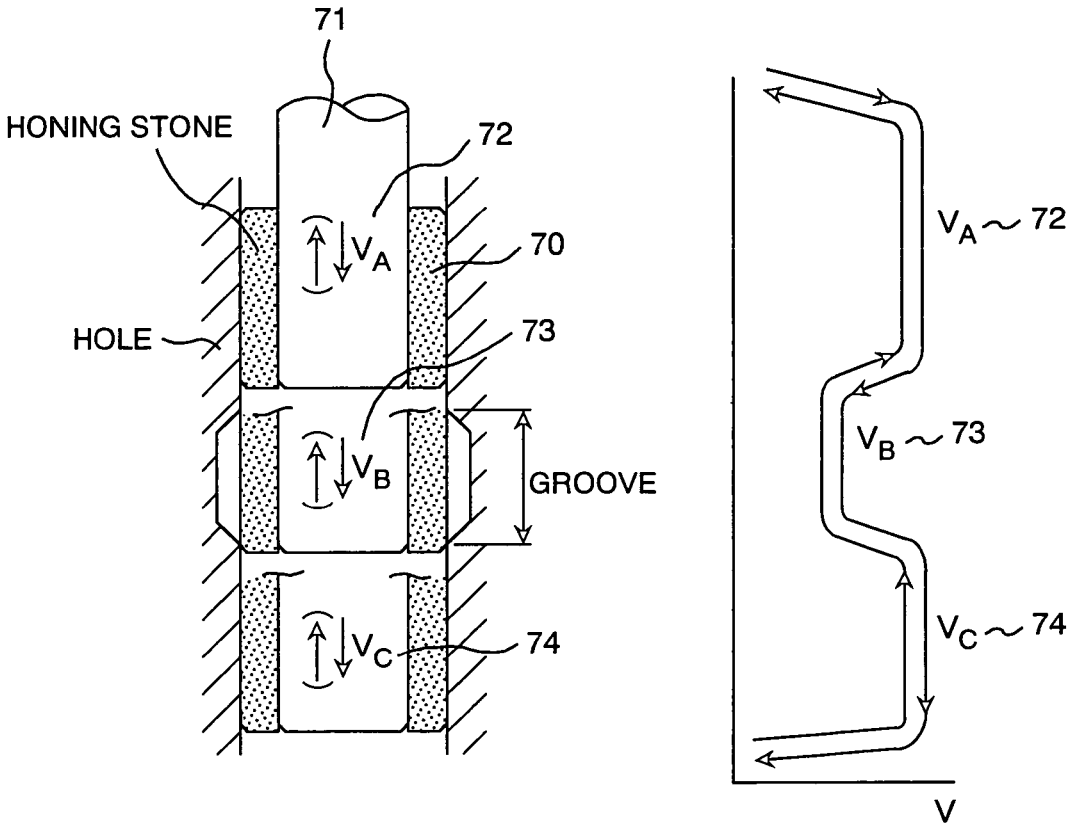
FIG. 11 is a cross sectional view representing the honing process of the cylinder of a high pressure pump as an embodiment of the present invention.

FIG. 11 shows the method for honing the bore 40 of the cylinder 4. In this example, with respect to the conditions for honing the bore on the portion from the compression chamber 6 of the cylinder 4 to the cylindrical groove 42 and conditions for honing the bore from the cylindrical groove 42 to the drive source side, the axial feed rate of the honing tool, out of the conditions for honing the bore connected to the cylindrical groove 42, is reduced at the cylindrical groove 42. This allows a smooth configuration of the intersection between the cylindrical grooves 42 and bore 40. Further, the same effect can be gained by changing one or more of honing stone speed, the number of reciprocating motions and axial dwell time as honing conditions.

FIG. 12 shows the high pressure fuel pump 1 as an embodiment of the present invention. This pump allows reduction of the clearance between the cylinder 4 and plunger 5 without reducing the productivity of the inner diameter of the cylinder 4, and permits smooth sliding. This makes it possible to manufacture a pump characterized by reduced fuel leakage, saved drive energy and improved compression efficiency.

Figure 13:
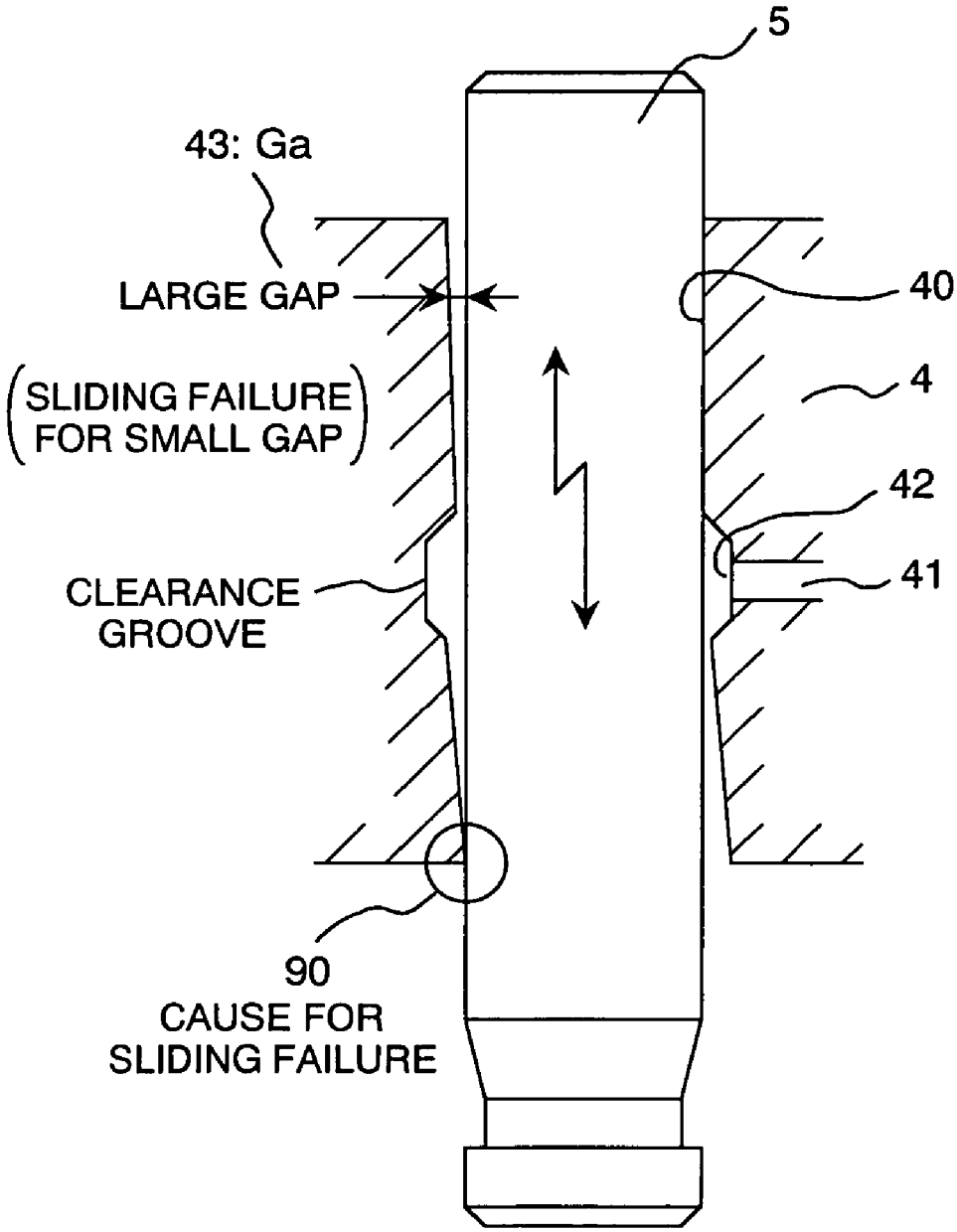
FIG. 13 is a cross sectional view representing the cylinder and plunger of a high pressure pump according to the prior art.

FIG. 13 shows the configuration of the cylinder 4 and plunger 5 of a prior art pump. Machining is performed to get the same accuracy over the entire range of the bore 40 of the cylinder 4. However, misalignment is likely to occur above and below the cylindrical groove 42. The sliding inhibiting factor 90 interferes with the plunger 5, with the result that smooth sliding cannot be ensured. This requires the clearance Ga 43 to be increased. This is accompanied by increased fuel leakage and deteriorated pump efficiency.

The present invention proposes a longitudinal section of a bore and the profile of a cylindrical groove to ensure optimization of both pump performances and productivity. It reduces the clearance between the cylinder and plunger with raising the costs by requesting severe parts accuracy, and provides a highly efficient high pressure pump characterized by higher sliding performances than those of the prior art. The present invention also provides a method for manufacturing such a pump.

What is claimed:

1. A high pressure pump comprising a housing and a cylinder in said housing wherein a shaft-like plunger makes a reciprocating motion in a bore formed in said cylinder to compress a fluid fuel; said high pressure pump, wherein one end of said plunger is connected to a compression chamber for compressing the fluid fuel, while the other end is connected to a reciprocating motion drive source through a member; wherein a transverse aperture is connected with the bore through a cylindrical groove provided between axially opposite ends of the bore of said cylinder; and the clearance between said bore and said plunger depends on the axial location along said bore, wherein $Ga \leqq Gb < Gc$ or $Ga < Gb \leqq Gc$ and, wherein:

Ga denotes a clearance between the bore on the portion from said compression chamber to said cylindrical groove and said plunger;

Gb a clearance closer to the cylindrical groove, out of the clearances between the bore from said cylindrical groove to the drive source side and said plunger; and Gc a clearance closer to the drive source side, out of the clearances between the bore from said cylindrical groove to the drive source side and said plunger.

2. The high pressure pump according to claim 1, wherein $Gc \leqq ((La+W+Lbc)/La) \times Ga$ wherein:

La is the width of said cylinder bore in the axial direction on the portion from the compression chamber to the cylindrical groove;

W the width of said cylindrical groove in the axial direction; and

Lbc the width of the portion from the cylindrical groove to the drive source side.

3. The high pressure pump according to claim 1, wherein a longitudinal section of said cylindrical groove gradually widens toward the bore of said cylinder, and the angle formed at the portion where said cylindrical groove contacts the bore is 5 degrees or more, but not more than 25 degrees with respect to axial direction of the bore.

4. The high pressure pump according to claim 3, wherein the width W of said cylindrical groove in the axial direction is $D \times 0.1$ or more, but not more than $D \times 0.6$ with respect to the inner diameter D of the bore.

5. A high pressure pump comprising a housing and a cylinder in said housing wherein a shaft-like plunger makes a reciprocating motion in a bore formed in said cylinder to compress a fluid fuel; said high pressure pump, wherein one end of said plunger is connected to a compression chamber for compressing the fluid fuel, while the other end is connected to a reciprocating motion drive source through a member; wherein a transverse aperture is connected with the bore throuah a cylindrical groove provided between axially opposite ends of the bore of said cylinder; and the clearance between said bore and said plunger depends on the axial location along said bore, wherein $Da \leqq Db < Dc$ or $Da < Db \leqq Dc$ and wherein:

Da denotes an inner diameter of the bore on the portion from said compression chamber to said cylindrical groove;

Db an inner diameter closer to the cylindrical groove, out of the inner diameters of the bore from said cylindrical groove to the drive source side; and Dc an inner diameter closer to the drive source side, out of the inner diameters of the bores of the cylinder from said cylindrical groove to the drive source side.

6. The high pressure pump according to claim 5, wherein $Dc \leqq ((La+W+Lbc)/La) \times Da$ wherein:

La is the width of said cylinder bore in the axial direction on the portion from the compression chamber to the cylindrical groove;

W the width of said cylindrical groove in the axial direction; and

Lbc the width of the portion from the cylindrical groove to the drive source side

7. The high pressure pump according to claim 5, wherein a longitudinal section of said cylindrical groove gradually widens towards the bore of said cylinder, and the angle formed at the portion where said cylindrical groove contacts the bore is 5 to 25 degrees with respect to an axial direction of the bore.

8. The high pressure pump according to claim 5, wherein the width W of said cylindrical groove in the axial direction is a bore inner diameter D of 0.1 to 0.6..

9. The high pressure pump according to claim 5, wherein $Ga \leqq Gb < Gc$ or $Ga < Gb \leqq Gc$, wherein Ga denotes a clearance between the bore on the portion from said compression chamber to said cylindrical groove and said plunger Gb a clearance closer to the cylindrical groove, out of the clearances from said cylindrical groove to the drive source, between the bore and said plunger; and Gc a clearance closer to the drive source, out of the clearances from said cylindrical groove to the drive source, between the bore and said plunger.

* * * * *